US005403193A

United States Patent [19]

Ito et al.

[11] Patent Number: 5,403,193

[45] Date of Patent: Apr. 4, 1995

[54] SMALL JUNCTION BOX FOR CONNECTING A WIRE HARNESS

[75] Inventors: Hirokazu Ito, Mie; Takayoshi Ito; Makoto Taguchi, both of Tochigi, all of Japan

[73] Assignees: Sumitomo Wiring Systems, Ltd., Mie; Honda Giken Kogyo K.K., Tokyo, both of Japan

[21] Appl. No.: 243,073

[22] Filed: May 13, 1994

Related U.S. Application Data

[63] Continuation of Ser. No. 904,321, Jun. 25, 1992, abandoned.

[30] Foreign Application Priority Data

Jul. 10, 1991 [JP] Japan ..... 3-197137

[51] Int. Cl.[6] ..... H01R 9/24

[52] U.S. Cl. ..... 439/34; 439/76

[58] Field of Search ..... 439/34, 76

[56] References Cited

U.S. PATENT DOCUMENTS

| | | | |
|---|---|---|---|
| 4,799,893 | 1/1989 | Ogawa et al. | 439/76 |
| 4,850,884 | 7/1989 | Sawai et al. | 439/76 |
| 4,869,675 | 9/1989 | Ogawa | 439/76 |
| 4,897,049 | 1/1990 | Miller et al. | 439/652 |
| 4,956,748 | 9/1990 | Yamamoto et al. | 439/34 |
| 4,959,018 | 9/1990 | Yamamoto et al. | 439/76 |
| 4,959,019 | 9/1990 | Shimochi | 439/76 |
| 4,995,818 | 2/1991 | Saimoto | 439/76 |
| 5,000,693 | 3/1991 | Hatagishi et al. | 439/34 |

*Primary Examiner*—Gary F. Paumen

*Attorney, Agent, or Firm*—Sughrue, Mion, Zinn, Macpeak & Seas

[57] ABSTRACT

A small junction box, for connecting a wire harness, comprises a power receptacle 14, a power supply connector 18, and at least one optional connecting socket 13. They are electrically connected with each other. The small junction box is detachably connected to a power receptacle of another junction box body through the power supply connector 18.

3 Claims, 5 Drawing Sheets

SMALL JUNCTION BOX FOR CONNECTING A WIRE HARNESS

This is a continuation of application Ser. No. 07/904,321, filed Jun. 25, 1992, now abandoned.

BACKGROUND OF THE INVENTION

1. Field of the Invention

This invention relates to a small junction box which is provided with a branched circuit and a group of fuses disposed in a middle portion of a wire harness, in particular, a wire harness for an automobile.

2. Statement of the Prior Art

For the purpose of convenience of explanation, construction of a conventional junction box body will be explained below with reference to FIG. 5. FIG. 5 shows a cross sectional view of the conventional junction box body.

The junction box body 1 comprises a lower resin cover 2 provided with a plurality of metal bus bars 3 for wiring therein and an upper resin cover 4 mounted on the lower cover 2.

The upper cover 4 is provided with fuse sockets 5 and 6 and a power receptacle 7. Relay terminals 5*a*, 5*b* and 6*a*, 6*b* are disposed in the fuse sockets 5 and 6 while connecting pins 7*a*, 7*b*, 7*c* and 7*d* formed by bending distal ends of the bus bars 3 are disposed in the power receptacle 7. The connecting pins 7*c* and 7*d* are arranged behind the connecting pins 7*a* and 7*b*, respectively, and thus are not shown in FIG. 5.

The relay terminals 5*a*, 5*b* and 6*a*, 6*b* are electrically connected to the bus bars 3 in the sockets 5 and 6 to form an electric wiring circuit. A wire harness 8 connected to the electric wiring circuit is drawn out of the junction box body 1 and supplies electric power to an emission control computer circuit (hereinafter referred to as "E/C circuit"), as an engine control circuit, through a connector (not shown).

Blade type fuses 5' and 6' of a given standard are attached to the fuse sockets 5 and 6, respectively.

A connector 9 for an ignition switch harness is mounted in the power receptacle 7. A cord 9a secured to the connector 9 is connected to an electric power source such as a battery or the like through an ignition switch (not shown).

However, wire harnesses for automobiles are becoming progressively more complicated in response to an increasing variety of electrical devices provided in automobiles. Accordingly, a simple junction box as mentioned above is insufficient for the above requirements.

In order to meet the above requirements, it is possible to increase the number of junction boxes, if desired. However, this requires greater space, more complicated circuitry, and an increase in production steps. It may also be possible to increase the number of sockets on the junction box or the number of wires taken from the box and to add such fuse sockets in compliance with such additions. However, this makes the junction box itself bulky so that a large space is required to accommodate it and design of the automobile is thus influenced. This is undesirable in that it inhibits the ability to incorporate a large number of devices in an engine compartment as required by current design standards. Accordingly, such a bulky junction box prevents tile utilization of the highly flexible design. Further, a bulky junction box is incompatible with mini-type cars. With the provision of junction boxes having necessary sockets for different kinds of cars, costs rise and manufacturing productivity is adversely affected.

If a junction box having a minimum number of sockets is provided, it is necessary to exchange the first junction box for one having the desired optional sockets when an optional device is incorporated. This is to be an inefficient and costly procedure.

SUMMARY OF THE INVENTION

An object of the present invention is to provide a small junction box to which can be added any desired socket or sockets and which can be detachably mounted on a junction box body for common use.

Another object of the present invention is to provide a small detachable junction box to which can be added any desired optional socket or sockets for common use and an electrical system of the socket can be checked readily.

In order to achieve the above objects, a small junction box, for connecting a wire harness, comprises a power receptacle, a power supply connector, and at least one optional connecting socket, which are electrically connected with each other. The small junction box is detachably connected to a power receptacle of another junction box body through the power supply connector.

It is possible to use a conventional junction box body having a uniform standard and to add any additional sockets to the small junction box of the present invention in compliance with additional devices, since the small junction box of the present invention includes the power receptacle, the power supply connector, and at least one optional socket, the power supply connector of the box being detachably coupled to the power receptacle of the conventional box body. Further, the small junction box of the present invention does not require a large space and any additional wiring operation on the production line, and can improve a production efficiency.

Electric power from the common power circuit (bus bar) in the small junction box is always supplied to the optional device and the E/C circuit as an engine control circuit. The process for checking the electric systems on the production line is made easy. It is possible to find a fault in the electric systems of the optional circuit, since the engine will not start if any fault occurs with the supply of electric power to the junction box.

DETAILED DESCRIPTION OF THE PREFERRED EMBODIMENTS

Referring now to FIGS. 1 through 4, an embodiment of a small junction box for connecting a wire harness in accordance with the present invention will be explained below.

Figure 1:
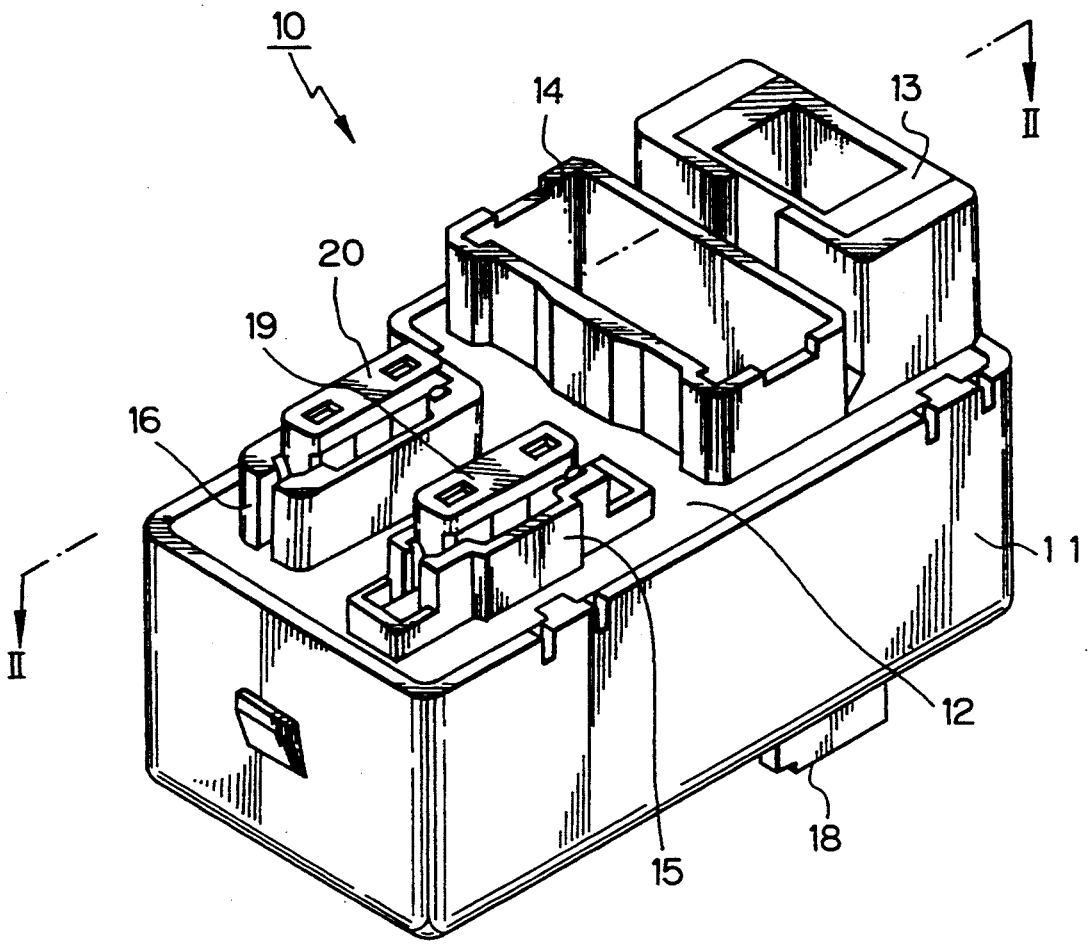
FIG. 1 is a perspective view of an embodiment of a small junction box in accordance with the present invention.
Figure 2:
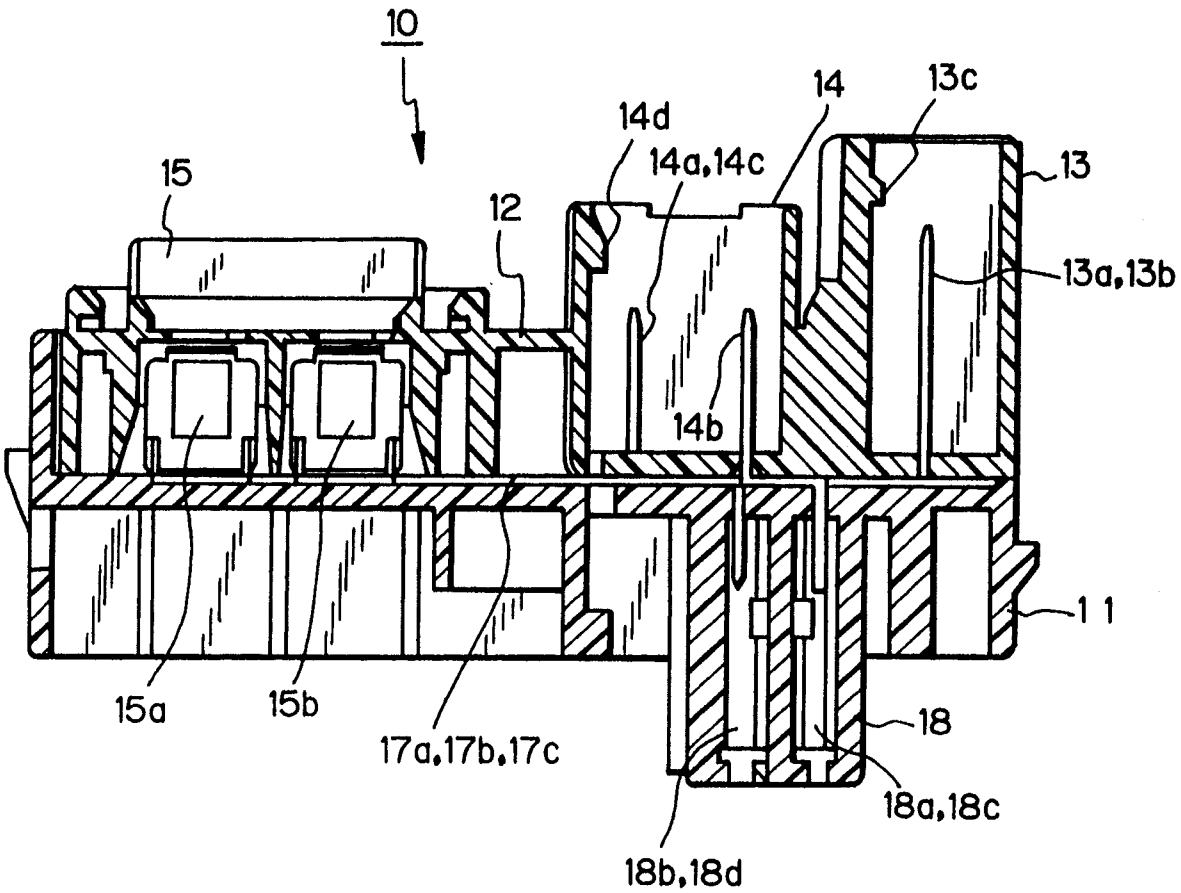
FIG. 2 is a sectional view taken along a line II—II in FIG. 1.

FIGS. 1 and 2 show an embodiment of a small junction box 10 of the present invention. In FIG. 1, fuses 19 and 20 are mounted on fuse sockets 15 and 16, respectively.

As shown in FIG. 1, the small junction box 10 includes a lower resin cover 11 and an upper resin cover 12. The upper cover .12 is provided with an optional socket 13, a power receptacle 14, a fuse socket 15 for an optional circuit and a fuse socket 16 for an E/C circuit.

The fuses 19 and 20 are mounted on the fuse socket 15 for the optional circuit and the fuse socket 16 for the E/C circuit and are provided with a blade type fuse (not shown) under a given standard within the respective sockets.

Bus bars 17*a*, 17*b*, and 17*c* for wiring, as shown in FIG. 2, are disposed within the small junction box 10. Connecting pins 13*a* and 13*b* in the optional socket 13, connecting pins 14*a*, 14*b*, and 14*c* in the power receptacle 14, and relay terminals 18*a*, 18*b*, 18*c* and 18*d* in a power supply connector 18 are formed by bending the bus bars 17*a*, 17*b*, and 17*c* at the respective ends or by welding them to another metal pin.

Relay terminals for connecting fuses 15*a*, 15*b*, and 16*a*, 16*b* are provided in the fuse sockets 15 and 16, respectively. The connecting pins 13*b* and 14*c* are disposed behind the connecting pins 13*a* and 14*a* while the relay terminals 16*a*, 16*b* and the bus bars 17*b*, 17*c* are disposed behind the relay terminals 15*a*, 15*b* and the bus bar 17*a*. These positional relations are not illustrated in FIG. 2.

Figure 3A:
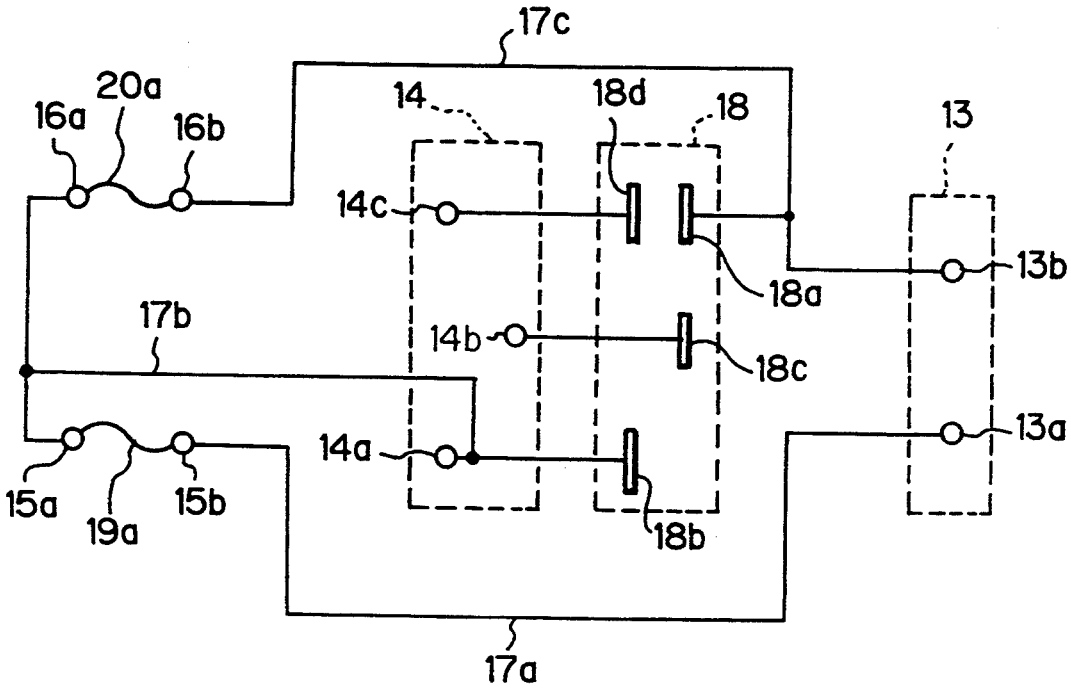
FIG. 3A is a plan view of an electric wiring taken from an above position in FIG. 2.
Figure 3B:
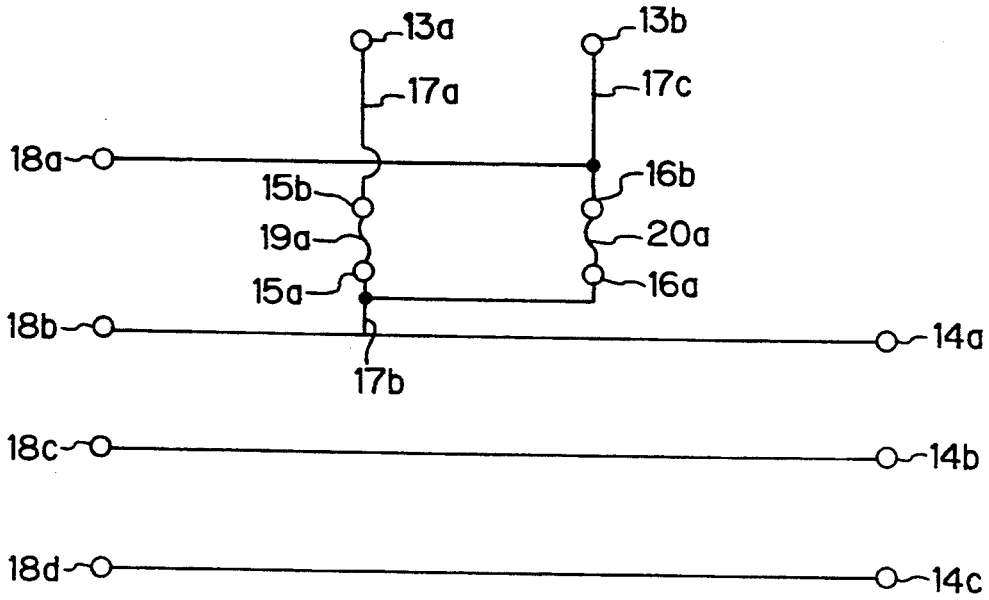
FIG. 3B is an electric wiring circuit of FIG. 3A.

FIG. 3A shows connecting relations among the connecting pins and the relay terminals when the small junction box 10 is viewed from above. FIG. 3B shows a wiring circuit of FIG. 3A. The connecting pins 14*b* and 14*c* in the power receptacle 14 are directly coupled to the relay terminals 18*c* and 18*d* in the power supply connector 18 to form a through circuit.

The connecting pin 14*a* is coupled to the relay terminal 18*b* and the relay terminals 15*a*, 16*a* through the bus bar 17*b*. The relay terminals 15*a* and 16*a* are coupled to the connecting pins 13*a* and 13*b* in the optional socket 13 through the fuses 19*a* and 20*a*, the relay terminals 15*b* and 16*b*, and the bus bars 17*a*, 17*c*, respectively. The relay terminal 16*b* is also coupled to the relay terminal 18*a* in the power supply connector 18.

In such wiring, the connecting pins 14*a*, 14*b* and 14*c* in the power receptacle 14 supply electric power directly to the relay terminals 18*b*, 18*c*, and 18*d* in the power supply connector 18 while the connecting pin 14*a* supplies electric power to the connecting pins 13*a* and 13*b* in the optional socket 13 through the fuses 19*a* and 20*a*, and to the relay terminal 18*a* in the power supply connector 18 through the fuse 20*a*, respectively.

In a usual wiring arrangement of wire harnesses in an automobile, one polarity of wires is arranged by the harness and the other polarity of the wires is grounded. In this embodiment, the connecting pins 14*a*, 14*b*, and 14*c* in the power receptacle 14 are coupled to, for example, an anode of a battery while the minus terminals or pins are coupled to a cathode of the battery through the chassis of an automobile.

The connecting pins 13*a* and 13*b* through which a low amount of electric current flows are plated with gold to provide a good electric contact on the plated faces.

Figure 4:
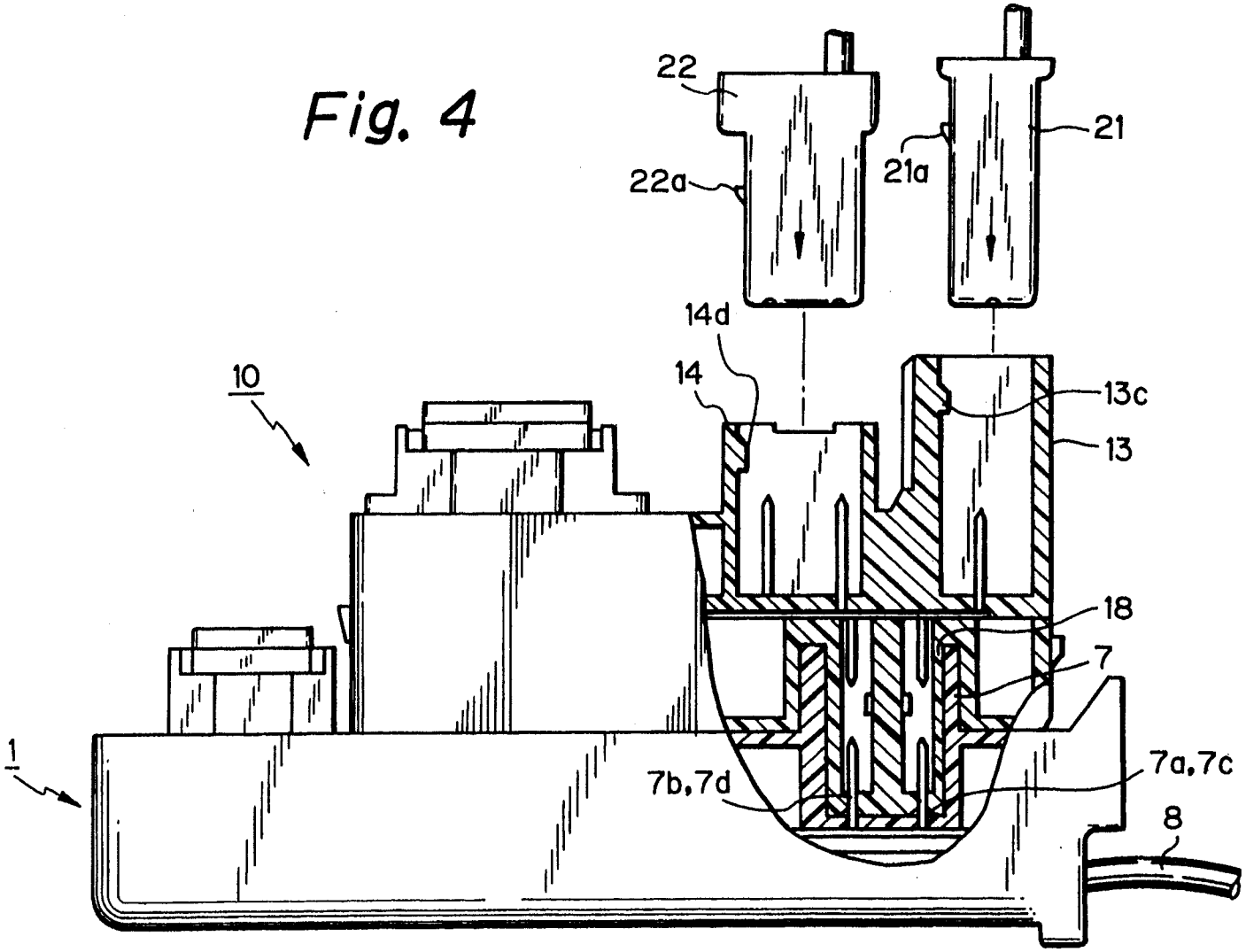
FIG. 4 is a partially broken side view illustrating the small junction box of FIG. 1 mounted on a conventional junction box body.
Figure 5:
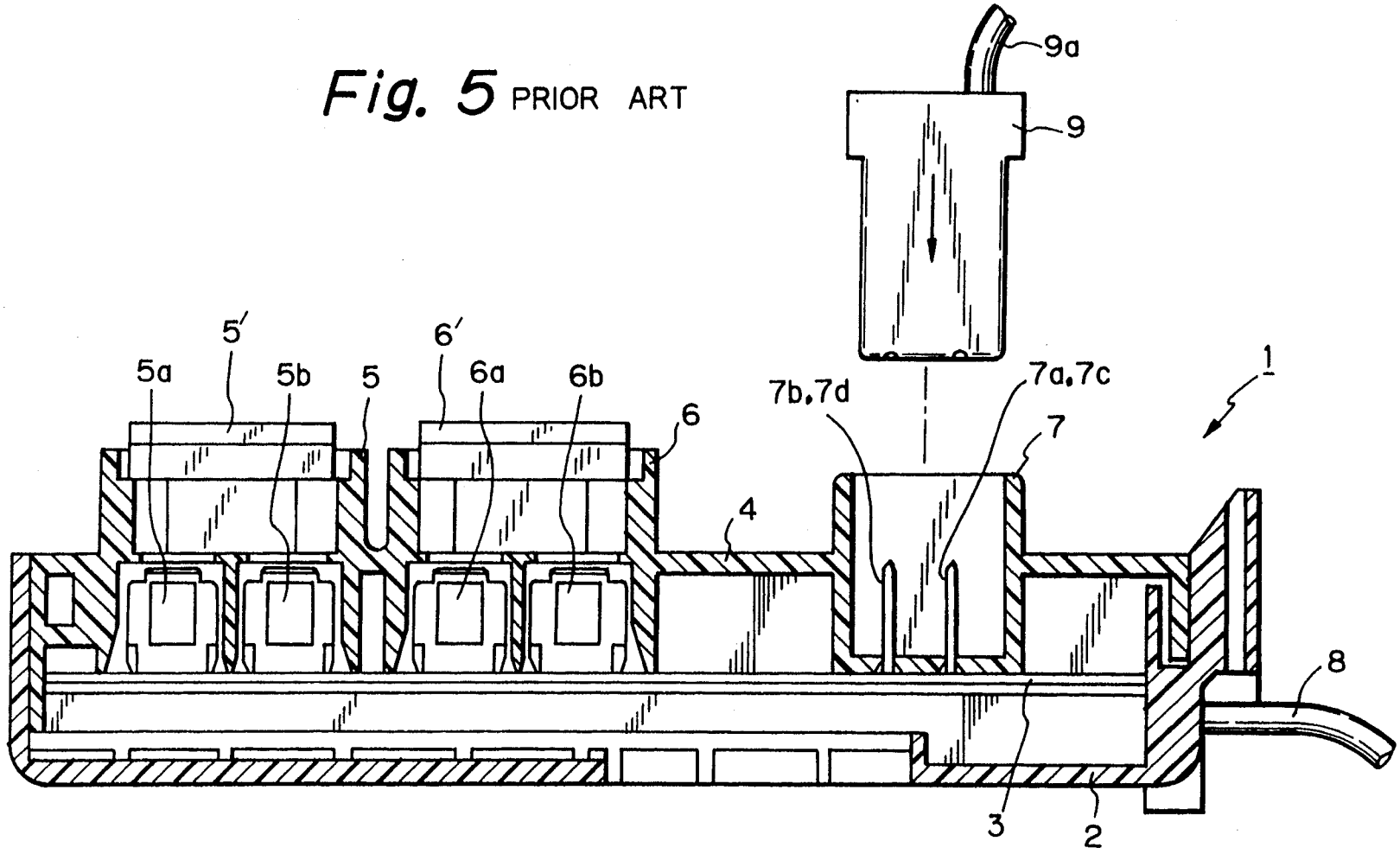
Fig. 5 PRIOR ART
FIG. 5 is a sectional view of a conventional junction box body.

Lock projections 13*c* and 14*d* shown in FIG. 4 are adapted to engage with projections 21*a* and 22*a* on an optional circuit connector 21 and a connector 22 for an ignition switch harness. Once the connectors 21 and 22 are mounted in the respective sockets 13 and 14, they are not disconnected from the sockets even under vibration and the like.

As shown in FIGS. 2 and 4, the relay terminals 18*a*, 18*b*, 18*c*, and 18*d* in the power supply connector 18 are coupled to the connecting pins 7*a*, 7*b*, 7*c*, and 7*d* when the connector 18 is inserted into the power receptacle 7 of the junction box body 1.

FIG. 4 shows that the power supply connector 18 of the small junction box 10 of the present invention is mounted in the power receptacle 7 of the conventional junction box body 1. This enables the optional circuit to be coupled to the wire harness 8 although heretofore the wire harness was coupled to only the E/C circuit through the junction box body 1.

Further, in the prior art, since an additional optional circuit had to be coupled to an optional harness through an additional junction box, it took a great deal of labour to check electric systems on a production line. The present invention, however, makes electric systems simple and common and thus simplifies the checking operation.

There occurs no possible electrical trouble in the sockets, even if the electric power should not be supplied to the optional circuit, since electric power is supplied to the optional circuit from a power circuit (bus bar) common to the E/C circuit, the connecting pins 13*a*, 13*b* in the optional socket 13 are plated with gold, and the socket 13 and the connector 21 for the optional harness are positively coupled with each other by a lock mechanism having lock projections 13*c* and 21*a*. Electrical problems may also arise in an electric power circuit outside the power receptacle 14. In this case, the electric power is not supplied to the E/C circuit in addition to the power supply connector 18. Consequently, it is impossible for an engine to be started. Consequently, it can be determined that an electrical fault has occurred in the optional circuit.

On the other hand, if the engine starts smoothly, it can be assumed electric power is properly supplied to the optional circuit. Accordingly, the checking of an optional circuit becomes very easy.

The lock mechanism which locks the connector 21 for the optional harness in the optional socket 13 is not limited to the lock projections 13*c* and 21*a* mentioned above. For example, either projection 13*c* or 21*a* may be changed to a lock recess, or double lock mechanisms may be provided by adding another pair of a lock pawl and lock lever.

A similar lock mechanism may be provided between the power supply connector 18 of the small junction box 10 and the power receptacle 7 of the junction box body 1 to increase a reliability of connection.

In the above embodiment, only one optional socket 13 is provided on the small junction box 10. However, it is possible to add other sockets to the box 10 in accordance with additional devices. In this case, the conventional junction box body 1 can be commonly used and there are no additional requirements placed upon a conventional production line.

It will be apparent from the foregoing description that it is possible to use a conventional junction box body having a uniform standard and to add any additional sockets to the small junction box of the present invention in response to a need for additional devices, because the small junction box of the present invention includes the power receptacle, the power supply connector, and at least one of the optional sockets, and the power supply connector of the box is detachably coupled to the power receptacle of the conventional box body. Further, the small junction box of the present invention does not require a large space or any additional wiring operation on the production line, and leads to both an improvement in production efficiency and a lowering of costs.

The electric power from the common power circuit in the small junction box is always supplied to the optional circuit and the engine control circuit. As such, the process for checking electric systems on the production line is made very easy. It is possible to find a fault in the electric systems of the optional circuit, since the engine does not start if any fault is caused in the electric power to be supplied to the junction box.

What is claimed is:

1. A small junction box in combination with a wire harness of an automobile, the automobile including an engine control circuit which is electrically connected to a connector plug, said small junction box comprising a power receptacle, a power supply connector, at least one fuse socket and at least one optional connecting socket, which are electrically connected with each other through a plurality of bus bars, characterized in that said small junction box is detachably connected to a power receptacle of another junction box body through said power supply connector, wherein said power receptacle of said small junction box has substantially the same configuration of a recess and connecting pins as the power receptacle of the junction box body which receives said small junction box, such that said power receptacle of said small junction box receives the connector plug which normally is inserted into the power receptacle of the junction box body, wherein said bus bars are connected to connecting pins in said power receptacle and said optional socket, and to relay terminals in said power supply connector and said fuse socket, and further wherein said power receptacle of said small junction box is operative to connect to the engine control circuit by engagement with the connector plug.

2. The small junction box as claimed in claim 1, wherein said fuse socket is disposed on said bus bars so that a fuse is mounted between said optional connecting socket and a branching point from said optional connecting socket and said power supply connector.

3. The small junction box as claimed in claim 1, wherein said fuse socket is disposed on said bus bars so that a fuse is mounted between said power receptacle and a branching point from said optional connecting socket and said power supply connector.

* * * * *